United States Patent [19]

Sakano

[11] Patent Number: 4,479,119

[45] Date of Patent: Oct. 23, 1984

[54] CRT DISPLAY DEVICE

[75] Inventor: Yukio Sakano, Tokyo, Japan

[73] Assignee: Ricoh Company, Ltd., Japan

[21] Appl. No.: 283,640

[22] Filed: Jul. 15, 1981

[30] Foreign Application Priority Data

| | | | |
|---|---|---|---|
| Jul. 16, 1980 | [JP] | Japan | 55-100043 |
| Jul. 29, 1980 | [JP] | Japan | 55-104014 |
| Aug. 20, 1980 | [JP] | Japan | 55-114275 |

[51] Int. Cl.[3] ..... G09G 1/16

[52] U.S. Cl. ..... 340/731; 340/749; 340/791

[58] Field of Search ..... 340/731, 749, 750, 723, 340/744, 791; 178/15, 30

[56] References Cited

U.S. PATENT DOCUMENTS

| | | | |
|---|---|---|---|
| 3,423,749 | 1/1969 | Newcomb | 340/731 |
| 3,659,283 | 4/1972 | Ophir | 340/749 X |
| 3,754,229 | 8/1973 | Manber | 340/750 X |
| 3,896,428 | 7/1975 | Williams | 340/731 |
| 3,911,420 | 10/1975 | Lampson | 340/749 X |
| 4,087,808 | 5/1978 | Herndon, Jr. | 340/749 |
| 4,168,489 | 9/1979 | Ervin | 340/731 |
| 4,322,717 | 3/1982 | Iida | 340/731 X |
| 4,357,604 | 11/1982 | Imazeki et al. | 340/749 X |

*Primary Examiner*—Marshall M. Curtis
*Attorney, Agent, or Firm*—Guy W. Shoup

[57] ABSTRACT

A CRT display device which includes a display control unit is provided. In accordance with the present invention, the frequency of a pulse train supplied to a shift register for producing a video signal from a dot pattern signal is adjusted or controlled in response to a mode selection signal. Therefore, a part of the characters may be displayed as compressed thereby increasing the density of displayed information without impairing clear observability.

9 Claims, 30 Drawing Figures

CRT DISPLAY DEVICE

BACKGROUND OF THE INVENTION

1. Field of the Invention

This invention generally relates to a CRT display device and in particular to a display control system of a raster-scanning type CRT display device for use in a system such as a word processor. More specifically, the present invention relates to a CRT display control system which allows all of the characters in a single print-out line to be displayed in a single row in the display area of a CRT screen by changing the pitch and the width size of some of the characters even if the number of the characters in a single line has increased.

2. Description of the Prior Art

The CRT display device has been widely used and has various applications, one of which is a word processor. As shown in FIG. 1, the word processor is generally comprised of a central processing unit (also referred to as CPU hereinbelow) 1, a keyboard 2 as an input device, a CRT 3 as an intermediate output device, a printer 4 as an output device and a file device 5 as the storage for information. In this system, word information such as letters, numbers and figures is introduced by the operator from the keyboard 2 and temporarily stored in the file device 5 according to the instructions fed from the CPU 1. The information thus introduced may be displayed on the screen of the CRT 3 for confirming and/or correcting the information before supplying the information to the printer 4. Also provided is a control unit 6 which interacts with each of the keyboard 2, CRT 3, printer 4 and file device 5, and thus the control unit 6 has an interfacing function.

For a CRT display device in which use is made of the dot matrix in displaying characters on the screen, it has been common practice to display a predetermined number of characters in a line with a fixed dot pitch as driven by a reference clock having a predetermined frequency. In such prior art CRT display devices, there was a limit in the number of characters to be displayed in one line or row of the display area. Accordingly, if the maximum or predetermined number of characters to be displayed in one line is 40, then those characters beyond 40 cannot be displayed in the same line at the same time.

FIG. 2 schematically shows the display area 7 on the screen of the CRT device 3. For the sake of simplicity, only representative characters 8 are shown in FIG. 2. It should, however, be understood that the display area 7 of FIG. 2 has a maximum capacity of displaying 960 characters. That is, the display area 7 has 40 columns in the horizontal or X direction and 24 rows in the vertical or Y direction. The characters 8 are displayed as equally spaced from each other in a line with a constant dot pitch in this example. The arrow A indicates the scanning direction across the area 7.

FIG. 3 shows one example of the character 8 which represents the English letter "A" as displayed by the dot matrix which includes 63 dots arranged in 7 columns $D_1$ through $D_7$ and 9 rows $L_1$ through $L_9$. In FIG. 3, the blackened dots are illuminated dots; whereas, the white dots are non-illuminated or blank dots, thereby the letter "A" is represented by the blackened or illuminated dots.

FIG. 4 shows in block diagram the architecture of the conventional control unit 6. An address signal ADR in the form of a code corresponding to a particular character to be displayed is supplied from the CPU 1 via the CPU bus 11. The ADR signal is then supplied to a refresh memory 14 and stored temporarily therein after passing through a column address selector 12 and a row address selector 13.

When clock signals generated by a timing pulse generator 22 are supplied to a column address counter 17, the counter 17 starts counting and its contents at the termination of the counting operation forms a column address signal to be supplied to the refresh memory 14 through the column address selector 12. The output from the column address selector 17 is also supplied to a horizontal synchronizing pulse generator 20 and to a line counter 19. The horizontal synchronizing pulse generator 20 supplies a horizontal synchronizing signal HS as its output, and the line counter 19 supplies a line signal as an input to a character generator 15. The output of the line counter 19 is connected to the input of a row address counter 18 which counts to form a row address of the refresh memory 14 upon completion of counting the one line of a character by the line counter 19. The output signal from the row address counter 18 is supplied to the refresh memory 14 via the row address selector 13; on the other hand, it is also supplied to a vertical synchronizing pulse generator 21 which supplies a vertical synchronizing signal VS as its output.

A particular cell of the refresh memory 14 is addressed by the column address and row address signals thus supplied, and a particular code thus addressed is supplied as an address signal to the character generator 15 for reading out the dot pattern information of a desired character. The dot pattern information is then supplied to a parallel-in-series-out shift register 16 to produce a video signal VI to be supplied to the CRT 3. In such prior art CRT display devices, since locations of displaying characters are predetermined in the display area on the screen of the CRT with a constant pitch or distance between the two adjacent characters, there is a maximum limit in the number of characters to be displayed in the display area. For example, if the display area is designed for 40 columns and 24 rows and a chain of characters to be displayed consists of 41 or more characters, then all of the characters cannot be displayed in a single row at the same time in prior art CRT display devices.

It is often desired that a greater number of characters be displayed in the display area at the same time as the volume of information to be handled increases. For example, in a system such as shown in FIG. 1, the printer 4 usually has an ability to print out a greater number of characters in a single row line on a print-out paper as compared with the number of characters to be displayed in a row line of the display area of CRT device 3. One example of such a print-out paper 9 is shown in FIG. 5 and 60 characters at maximum may be printed out in a single row in this example, which is far greater than the maximum number of characters, which is 40, to be displayed in a single row in the display area 7 of the CRT device 3 as shown in FIG. 2. In this case, 20 of 60 characters to be printed out in a single row cannot be shown in the display area 7, which is quite inconvenient for the operator.

It is true that use may be made of a large-sized display area which is capable of displaying characters in the same manner as they are printed out. However, this is not advantageous because manufacturing a large-sized CRT can be quite expensive. Alternatively, all of the characters may be reduced in size to be fully displayed in the display area 7. This is also disadvantageous because smaller-sized characters are hard to see and frequent change in the size of characters will easily tire the operator.

Under the circumstances, there were three conventional approaches to cope with this problem. First approach was to divide the total column number of characters to be printed out, e.g., 60 in the above example, into two parts and to display these in sequence one after the other. That is, the first 40 columns of characters are displayed at one time and subsequent thereto the remaining 20 columns of characters are displayed. Second approach was to divide the total number of characters to be printed out in a single row into two parts and to display them in two consecutive rows as shown in FIG. 6. Third approach was to project characters toward the display area 7 in the same format as they are printed out with the excessive ones projected to the right or left of the area 7 as shown in FIG. 7 thereby the excessive ones do not fall onto the display area. In the example shown in FIG. 7, 60 columns of characters are projected but only 40 of them are displayed in the display area 7 at the same time. The character columns are then shifted to the left or right as appropriate to display all of the columns of characters in sequence. This third approach is called the scroll display method.

However, none of the above-described conventional approaches is satisfactory. For example, in the second approach, one print-out line requires two rows in the display area, which is quite disadvantageous since the display capacity is not fully used. Moreover, this approach requires a complicated display control unit and the characters displayed are rather difficult to observe. On the other hand, the first and second approachs are disadvantageous in that all of the columns of characters are not displayed at the same time so that they are dependent upon the ability of the operator to memorize what he or she has seen during operation.

Particularly for a system like a word processor, the editing function to change the arrangement of letters and words is very important. In this instance, it is quite inconvenient if all of the characters in a single row are not shown in the display area at the same time.

SUMMARY OF THE INVENTION

The disadvantages of the prior art are overcome with the present invention and an improved display control system for use in a CRT display device is provided.

In accordance with one aspect of the present invention, a raster scanning type CRT display device comprises a character pattern generator for generating a dot pattern signal; a shift register for converting said dot pattern signal into a video signal which is to be applied to a CRT; a clock generator for supplying a clock pulse signal to said shift register; and frequency adjusting means connected to said clock generator for changing the clock pulse frequency of said clock generator, thereby characters are displayed in desired width size and pitch depending on the location of the display area of CRT.

Preferably, the clock generator includes a plurality of different frequency components and one of the components is selected by said frequency adjusting means depending on the location of the display area. A mode selection signal is supplied to the frequency adjusting means thereby timing of changing the clock pulse frequency of the clock generator is determined in response to a particular mode selected. The frequency adjusting means preferably comprises a character counter and a counter selector, and the mode selection signal is supplied to the counter selector. The clock generator preferably comprises a fundamental oscillator, a clock counter and a clock selector. Alternatively, the clock generator may be comprised of a fundamental oscillator and a programmable clock counter.

The frequency adjusting means may be comprised of a column counter and a counter controller wherein a particular region of the display area of CRT, which is defined by the character columns previously set in the column counter, is scanned with a frequency different from that of the other display region.

It is further preferable to supply a cursor address signal to the present display control system so that characters in the region of interest in the display area of CRT may be displayed in the standard format at all times.

Accordingly, it is an object of the present invention to provide an improved display control system of a CRT display device.

Another object of the present invention is to provide a CRT display device in which some of the characters may be displayed in a format different from the standard format.

A further object of the present invention is to provide a CRT display device in which some characters are displayed as compressed depending on the location of the display area of CRT.

A still further object of the present invention is to provide a CRT display device particularly useful for use in a system such as a word processor.

Other objects, advantages and novel features of the present invention will become apparent from the following detailed description of the invention when considered in conjunction with the accompanying drawings.

DESCRIPTION OF THE PREFERRED EMBODIMENTS

Figure 8:
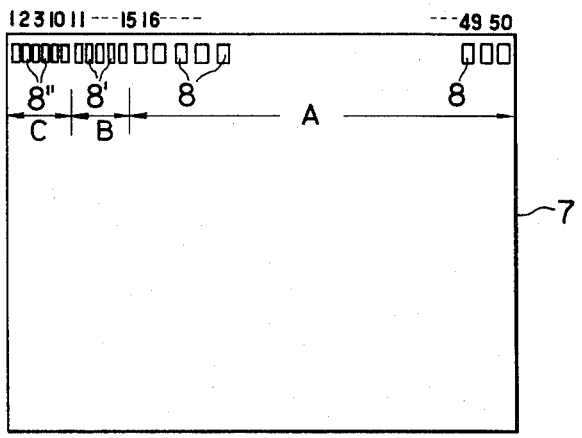
FIG. 8 is a schematic illustration showing the display area 7 in which left-side characters are displayed as compressed in accordance with the present invention.
Figure 9:
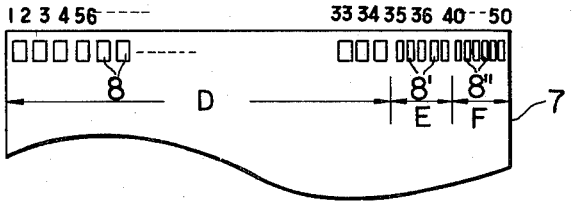
FIG. 9 is a schematic illustration showing the display area 7 in which right-side characters are displayed as compressed in accordance with the present invention.
Figure 10:
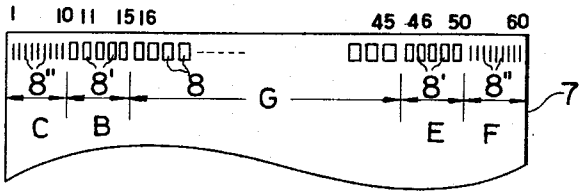
FIG. 10 is a schematic illustration showing the display area 7 in which both left-side and right-side characters are displayed as compressed in accordance with the present invention.

Referring now to FIGS. 8 through 10, there are shown some examples of displaying the increased number of characters in the display area 7, which is designed to display 40 colums of characters in standard conditions, in accordance with the present invention. Squares and rectangles represent characters, such as letters, numbers and figures, which are displayed in the display area 7. For the sake of simplicity, only some of the characters in the topmost row are shown in these figures. The numbers shown above the top side of the display area 7 indicate the corresponding columns of the characters displayed in the display area 7.

As shown in FIG. 8, the display area 7 is divided into three regions A, B and C. In the region A, characters 8 are displayed with the standard size and pitch; whereas, in the region B, characters 8' are displayed with the size and pitch which are ½ of those in the region A and, in the region C, characters 8" are displayed with the size and pitch which are ½ of those in the region B, or ¼ of those in the region A. As a result, the display area 7, designed to display 40 columns of characters having the standard size and arranged with the standard pitch, is now capable of displaying 50 columns of characters, i.e., 35 columns in the region A, 5 columns in the region B and 10 columns in the region C. It is to be noted that the characters in the remaining rows are displayed similarly with the topmost row.

FIG. 9 shows another mode of display in accordance with the present invention, in which right-side characters are displayed with reduced sizes and pitches. As shown, the D region includes 35 columns of characters 8 which are of the standard size and arranged with the standard pitch, and, therefore, this region corresponds to the region A in FIG. 8. The region E includes 5 columns of characters 8', the size and pitch of which are ½ of those in the region D, and, therefore, this region corresponds to the region B in FIG. 8. The region F includes 10 columns of characters 8" having the size and pitch which are ½ of those in the region E, so that this region corresponds to the region C in FIG. 8. Accordingly, this mode also allows to display 50 columns of characters in total, which is in excess of 10 columns of characters as compared with the standard mode shown in FIG. 2.

FIG. 10 shows a further mode of display, which is a combination of the above two modes, in accordance with the present invention. In this mode, the regions C and B correspond to the regions C and B of FIG. 8 and the regions E and F correspond to the regions E and F of FIG. 9. On the other hand, the region G includes 30 columns of characters of the standard size and pitch. Therefore, the mode of FIG. 10 includes 60 columns of characters in total, which is in excess of 20 columns as compared with the standard mode shown in FIG. 2.

Figure 1:
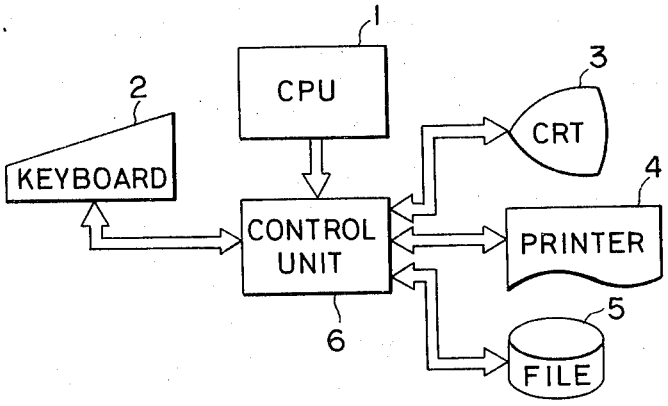
FIG. 1 is a schematic illustration showing one example of the system to which a CRT display device is incorporated.
Figure 2:
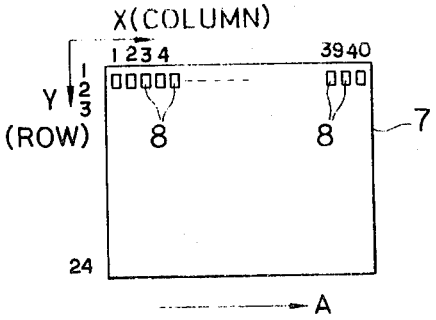
FIG. 2 is a schematic illustration showing the display area 7 on the screen of a CRT in which representative characters 8 are shown as arranged with a predetermined, constant pitch in 40 columns and 24 rows.
Figure 24:
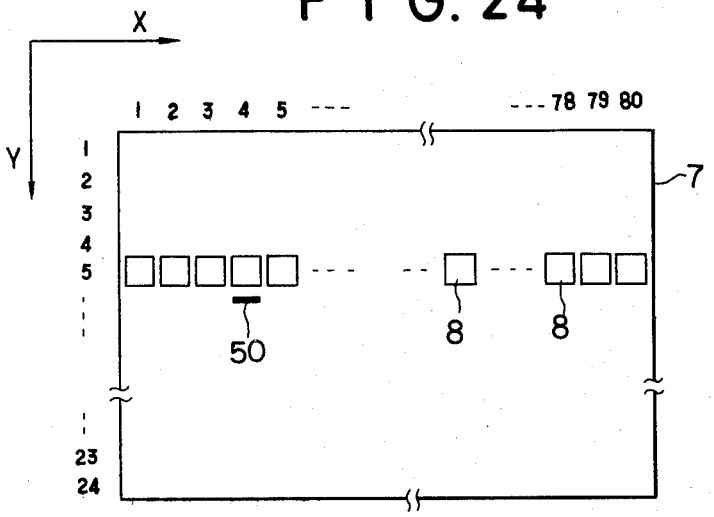
FIGS. 24, 25, 26 and 27 are schematic illustrations showing four different modes of display with the cursor 50 indicated in the region of interest within the display area 7.
Figure 25:
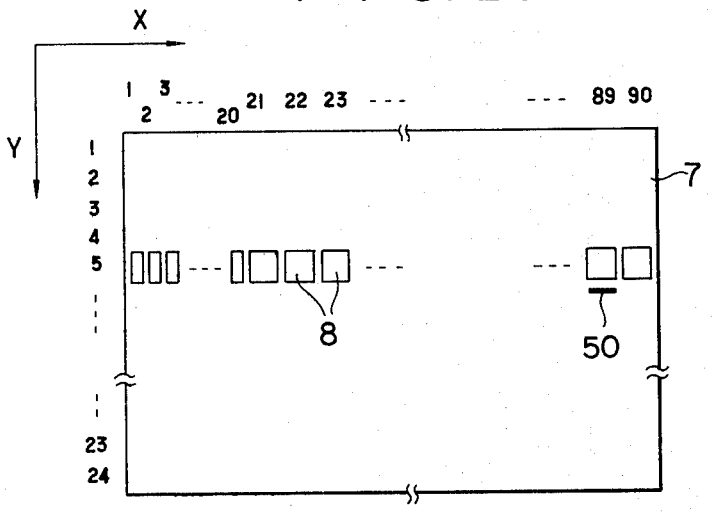
Figure 26:
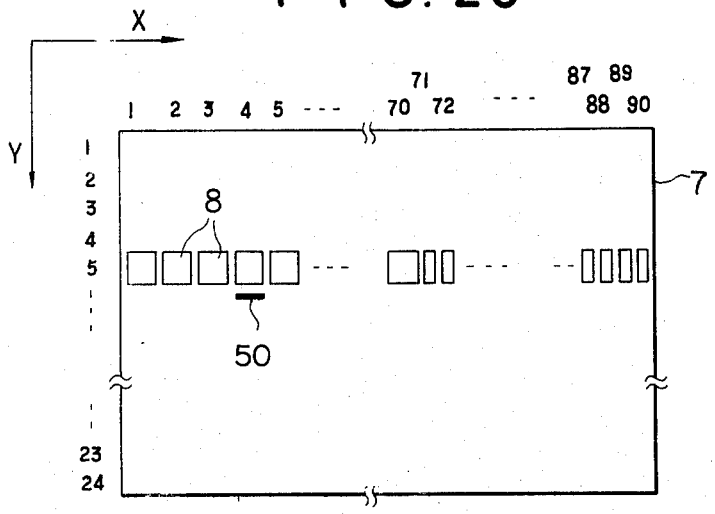
Figure 27:
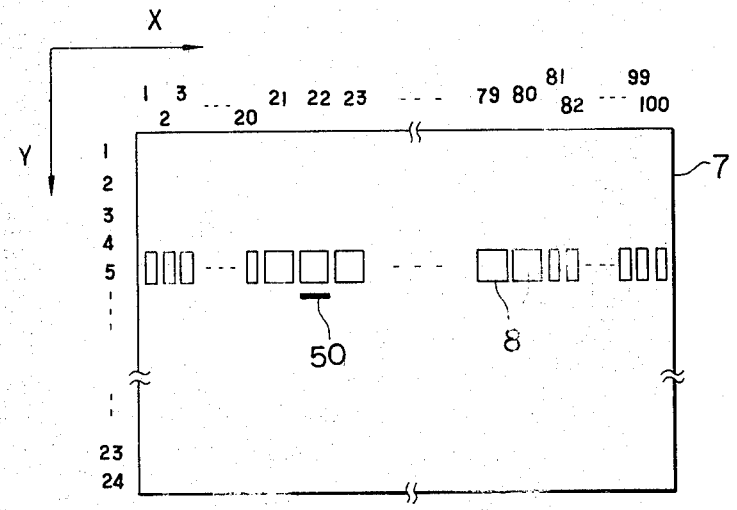

As described above, the present invention includes four different display modes, i.e., the standard mode shown in FIG. 2 and the modified modes shown in FIGS. 8 through 10. For convenience, these four display modes shown in FIG. 2 and FIGS. 8 through 10 will be referred to as display modes 1 through 4, respectively. In other words, the display mode 1 corresponds to the standard mode in which characters are displayed in the standard format as shown in FIGS. 2 and 24. The display mode 2 corresponds to the case where characters in some left-side columns in the display area are displayed as compressed as shown in FIGS. 8 and 25. The display mode 3 corresponds to the case where characters in some right-side columns in the display area are displayed as compressed as shown in FIGS. 9 and 26. And, the display mode 4 corresponds to the case where the modes 2 and 3 are combined as shown in FIGS. 10 and 27.

Figure 11:
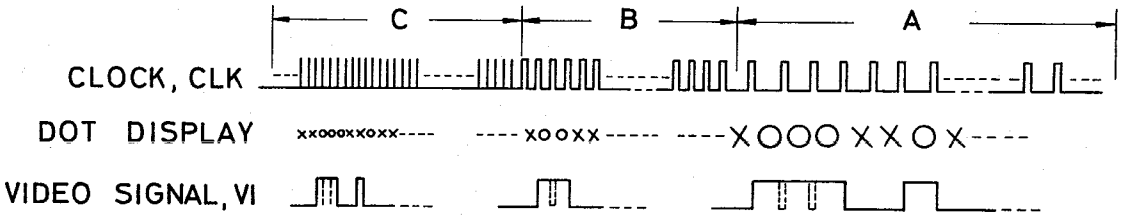
FIG. 11 is a timing diagram showing the relationship between the clock signal CLK, dot display and video signal VI.

Referring now to FIG. 11 which shows the relationship between the clock pulse signal CLK, the dot display and the video signal VI, the regions A, B and C correspond to the regions A, B and C in the display area 7 shown in FIG. 8. The frequency of the clock pulse signal CLK corresponds to the frequency of appearance of dots. Thus, the frequency of dot appearance in the region B is twice as that of the region A and the dot appearing frequency in the region C is twice as that of the region B. The dot display shown in FIG. 11 includes circles and crosses in which the circles represent illuminated dots with the crosses representing nonilluminated or blank dots.

If the character 8 is comprised of a dot matrix having 24 columns of dots and 28 rows of dots, one character column includes 24 columns of dots, and, therefore, the region A includes 24 dot columns×35 character columns=840 dots or pulses, the region B 24 dot columns×5 character columns=120 dots or pulses, and the region C 24 dot columns ×10 character columns=240 dots or pulses.

As regards the video signal VI shown in FIG. 11, the high level portion corresponds to the illuminated dot, and, in the example shown in FIG. 11, the consecutively illuminated dots constitute a continuously high level portion and they are not displayed as divided. Of course, it may also be so structured to shape one independent high level portion in the video signal VI for each of the illuminated dots. In this case, the consecutively illuminated dots will not form a continuously high level portion, but will form individual and discrete high level portions as indicated by the dotted lines. The former method is called the non-return-to-zero method; whereas, the latter method is called the return-to-zero method. It is to be noted that either method may be applied to the present invention.

Figure 12:
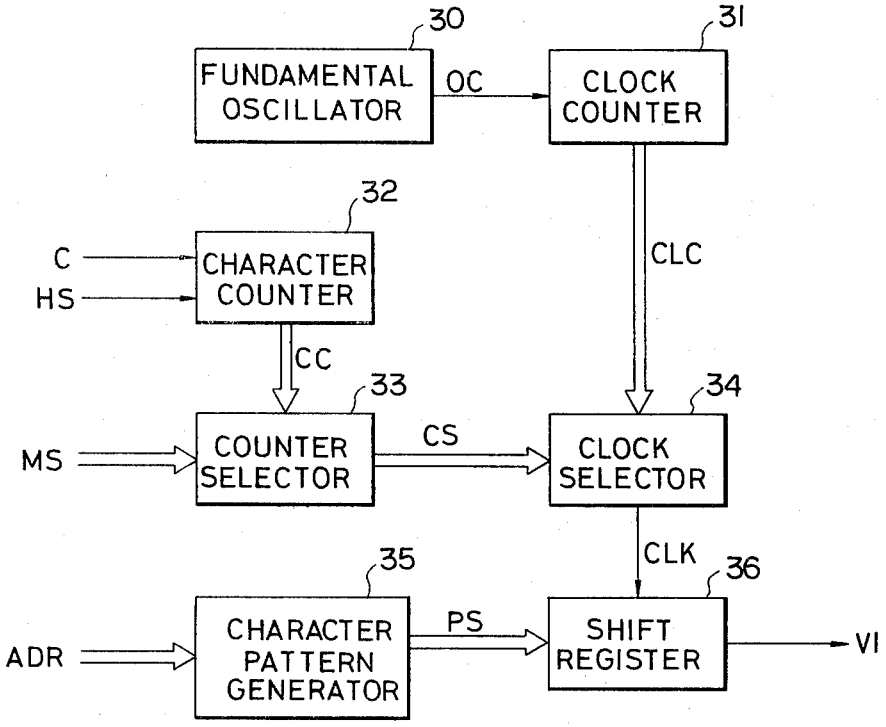
FIG. 12 is a block diagram showing one embodiment of the present invention.

FIG. 12 is a block diagram showing the structure of producing the clock pulse signal CLK and the video signal VI shown in FIG. 11 in accordance with the present invention. As shown, there is provided a fundamental oscillator 30 which supplies a fundamental clock pulse signal OC having a constant frequency to a clock counter 31, which, in turn, counts the number of clock pulses of the signal OC and supplies a signal CLC to a clock selector 34. These elements 30, 31 and 34 constitute a timing unit or clock generator. There is also provided a character counter 32 which receives a character signal C and a horizontal synchronizing signal HS and supplies a signal CC to a counter selector 33 which also receives a mode selection signal MS. The output of the counter selector 33 constitutes a counter select signal CS which is supplied as an input to the clock selector 34. The clock selector 34 supplies the clock pulse signal CLK having different frequencies as its output as shown in FIG. 11. The frequencies of the clock pulse signal CLK are determined by the contents of the clock signal CLC which are selected by the contents of the counter select signal CS in accordance with the regions of the display area 7 such as A, B, C, etc. Also provided is a character pattern generator 35 which receives an address signal ADR and supplies a character pattern signal PS having the character pattern information thus addressed to a shift register 36. Therefore, in response to the clock pulse signal CLK, the shift register 36 supplies the video signal VI which contains the addressed character information serial in time as shown in FIG. 11.

Figure 13:
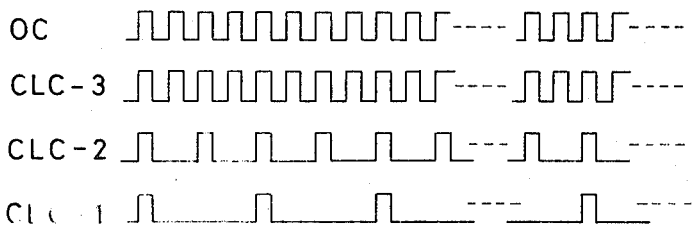
FIG. 13 is a timing diagram showing the input and output signals of the clock counter 31 in FIG. 12.
Figure 14:
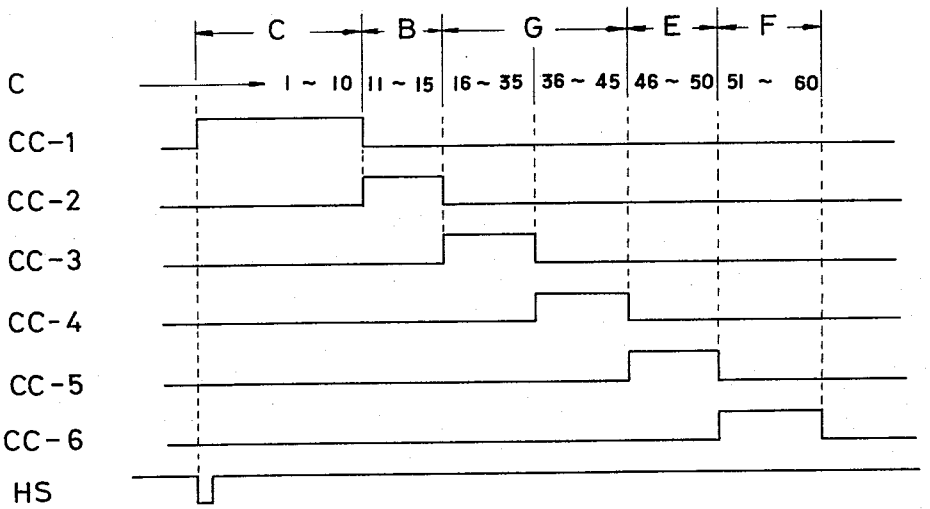
FIG. 14 is a timing diagram showing the input and output signals of the character counter 32 in FIG. 12.

The clock signal CLC includes three signals CLC-1, CLC-2, and CLC-3, which are different in frequency from each other as best shown in FIG. 13. The character signal C is a signal which has one pulse for each character column, and the character counter output signal CC includes 6 signals of CC-1, CC-2, CC-3, CC-4, CC-5 and CC-6, each of which has a different timing pulse as best shown in FIG. 14. The mode selection signal MS is to select one of the four display modes as described above and it includes four signals of MS-1, MS-2, MS-3 and MS-4 which may be selectively produced by the operation of the display control circuit or central processing unit, or the manual operation of the keyboard by the operator. As stated above, the counter select signal CS selects one of the three clock signals CLC-1 through CLC-3 in accordance with the regions of the display area 7.

FIG. 13 is a waveform diagram showing the waveform of each of the fundamental clock pulse signal OC and the three clock pulse signals CLC-1 through CLC-3. As shown, the frequency of the signal CLC-2 is twice as that of the signal CLC-1 and the frequency of the signal CLC-3 is twice as that of the signal CLC-2, and, therefore, four times as that of the signal CLC-1.

FIG. 14 is a time chart showing the relationship between the input and output signals of the character counter 32. For simplicity's sake, the character signal C is not shown, but some of the character column numbers are shown to indicate the boundary between the adjacent regions in the display area 7. The regions C, B, G, E and F in FIG. 14 correspond to the likely indicated regions in FIG. 10. For example, the character counter output CC-2 is a signal for the region B and it holds a high level state or the state of the binary number "1" for the duration of 5 character columns from the 11th to the 15th.

Figure 15:
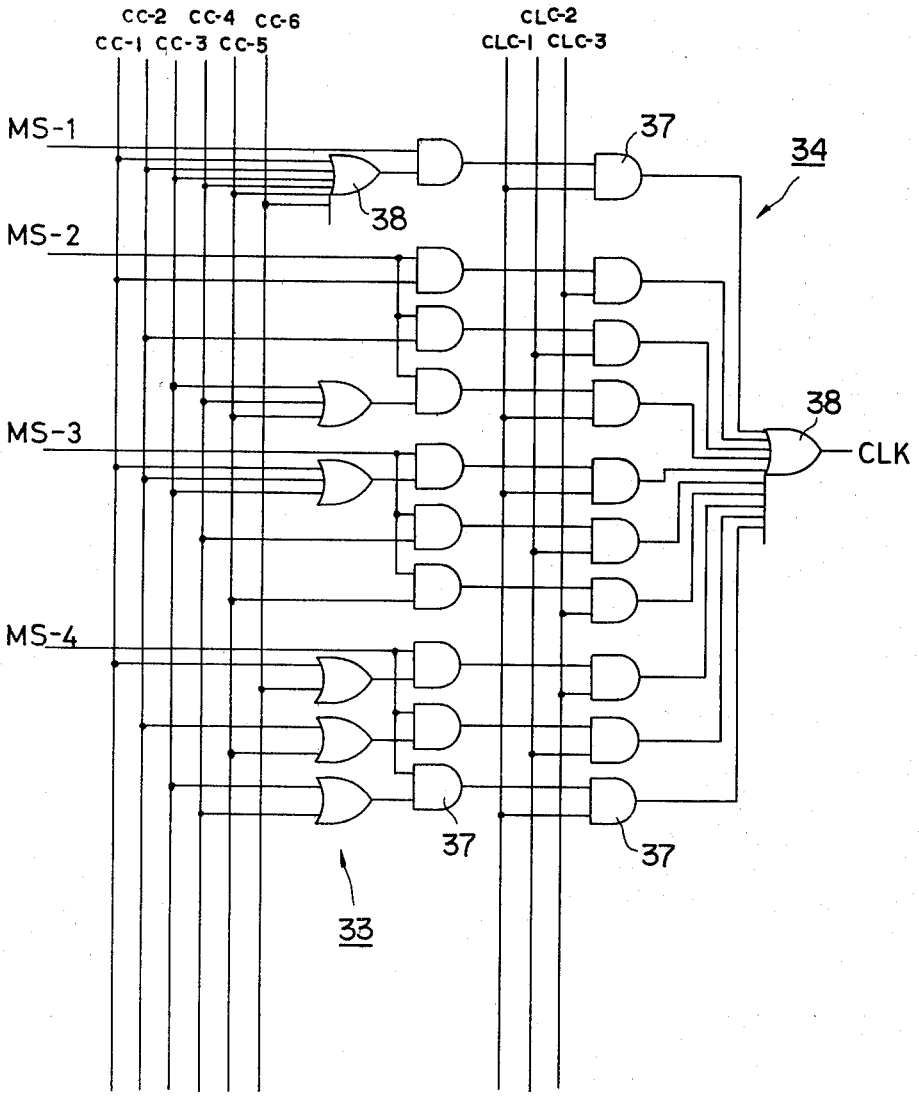
FIG. 15 is a logic circuit showing the detailed structure of the counter selector 33 and the clock selector 34 in FIG. 12.

FIG. 15 is a logic circuit which shows the detailed structure of the counter selector 33 and the clock selector 34. As shown, these selectors 33 and 34 are each formed by the combination of AND gates 37 and OR gates 38. It will be apparent for those skilled in the art that application of the character counter output signals CC-1 through CC-6 and the mode selection signals MS-1 through MS-4 to the counter selector 33 will determine the display mode thereby defining appropriate regions such as A, B and C within the display area 7. Then, application of the clock counter output signals CLC-1 through CLC-3 to the clock selector 34 will determine the dot appearing frequency and the clock pulse signal CLK is supplied as an output of the clock selector 34.

Figure 16:
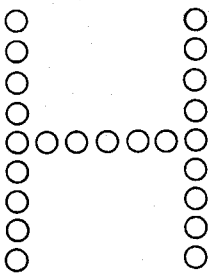
FIGS. 16, 17 and 18 show three forms of the letter "H" displayed in the form of dot matrix in accordance with the present invention.
Figure 17:
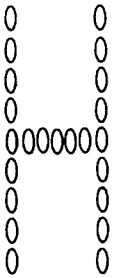
Figure 18:
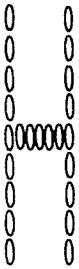

FIGS. 16 through 18 show examples of the letter "H" displayed in accordance with the present invention. It should be noted that only for the purpose of illustration the letter "H" is formed by a dot matrix which includes 7 columns of dots×9 rows of dots. FIG. 16 shows the case when displayed in the region A of FIG. 8 and FIGS. 17 and 18 show the cases when they are displayed in the regions B and C, respectively. It should be understood that all of these displayed characters different in size and pitch are formed from the same character pattern information supplied by the same character pattern generator as modified by the clock pulse signal CLK in accordance with the present invention.

Figure 19:
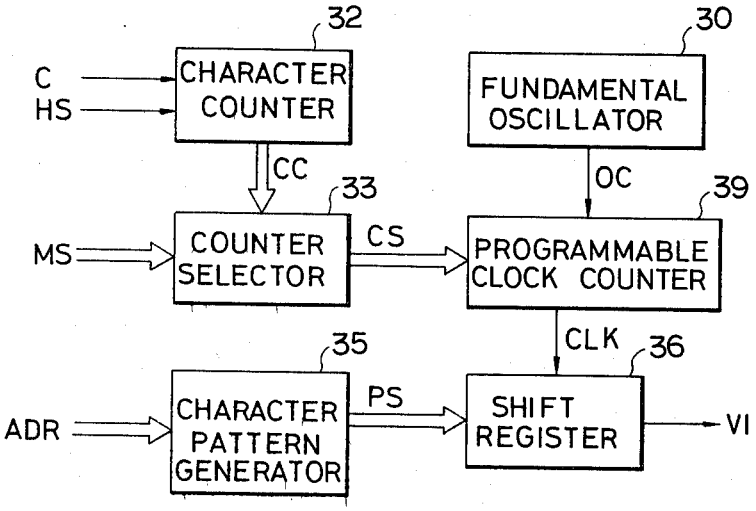
FIG. 19 is a block diagram showing another embodiment of the present invention.

FIG. 19 shows another embodiment of the present invention for producing the clock pulse signal CLK to be supplied to the shift register 36. In this embodiment, use is made of a programmable clock counter 39 instead of the ordinary clock counter 31 thereby omitting the clock selector 34 of the embodiment shown in FIG. 12.

Figure 20:
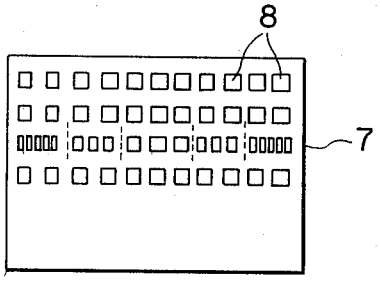
FIG. 20 is a schematic illustration showing one example of displaying characters in accordance with the present invention.

It should be clearly understood that the change of frequency shown in FIG. 11 is nothing but one example of the present invention and the same arguments hold for the manner of dividing the display area into a plurarity of regions typical examples of which are shown in FIGS. 8 through 10. For example, the division into regions may be made by counting the number of clock pulses or dots as initiated from the horizontal synchronizing pulse or the leftmost dot in the display area, or by measuring the time elapsing from the horizontal synchronizing pulse. Furthermore, in the example shown in FIG. 11, the frequency was maintained at constant in each of the regions. However, if desired, the frequency may be continuously varied within a particular region. Besides, as shown in FIG. 20, it is also possible to display characters in such a manner that only one or some of the rows has characters different in size and pitch.

Figure 21:
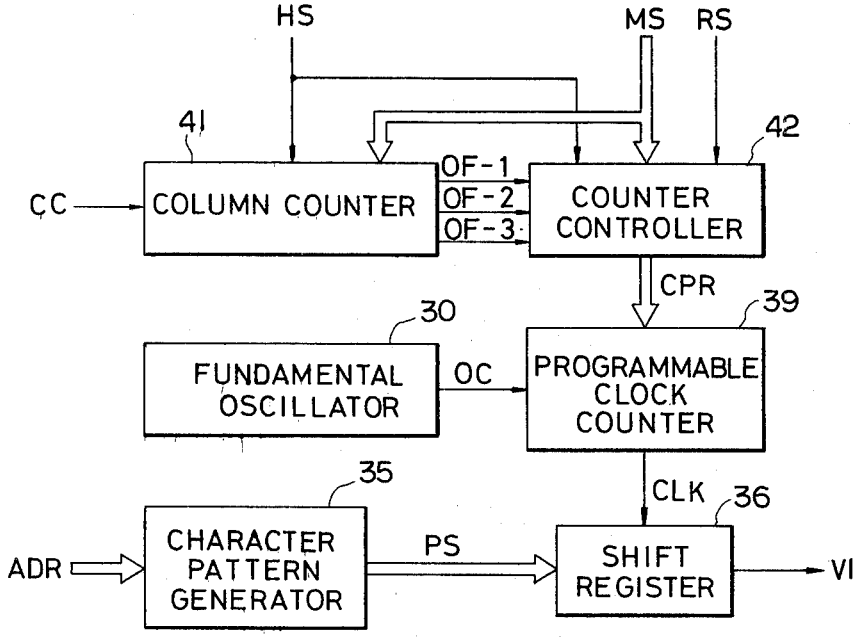
FIG. 21 is a block diagram showing a further embodiment of the present invention.

FIG. 21 shows a block diagram of a further embodiment of the present display control system. Structurally, this embodiment is similar to that shown in FIG. 19 and like numerals indicate like elements as practiced throughout this specification. In the embodiment shown in FIG. 21 as different from the embodiment shown in FIG. 19, there are provided a column counter 41 and a counter controller 42 instead of the character counter 32 and the counter selector 33.

The column counter 41 counts the number of characters or columns in a single row and its counting operation proceeds with the application of the character count signal CC which is supplied as a pulse signal every time when all of the dots forming one character are displayed in the display area. The column counter 41 is reset when the horizontal synchronizing signal HS is applied. The column counter 41 is structured to supply overflow signals OF-1 through OF-3 to the counter controller 42 as in the following manner. That is, supposing that the present display device is in the display mode 3 as shown in FIG. 26, when the counter counts up to a second predetermined number "70", the second overflow signal OF-2 is supplied. Then, as a result of further counting operation, when the counter 41 reaches a first predetermined number "81", the first overflow signal OF-1 is supplied as an output. Still further, upon arriving at a third predetermined number "90", the third overflow signal OF-3 is supplied.

The counter controller 42 supplies a counter program signal CPR to the programmable clock counter 39. As shown, the counter controller 42 receives the mode selection signal MS and a reset signal RS as well as the overflow signals OF-1 through OF-3 and the horizontal synchronizing signal HS. The counter controller 42 is initialized upon receipt of the reset signal RS.

Figure 3:
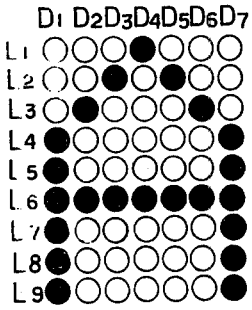
FIG. 3 is a schematic illustration of the dot matrix representation of the character 8 in which the letter "A" is indicated as an example by the blackened dots.
Figure 4:
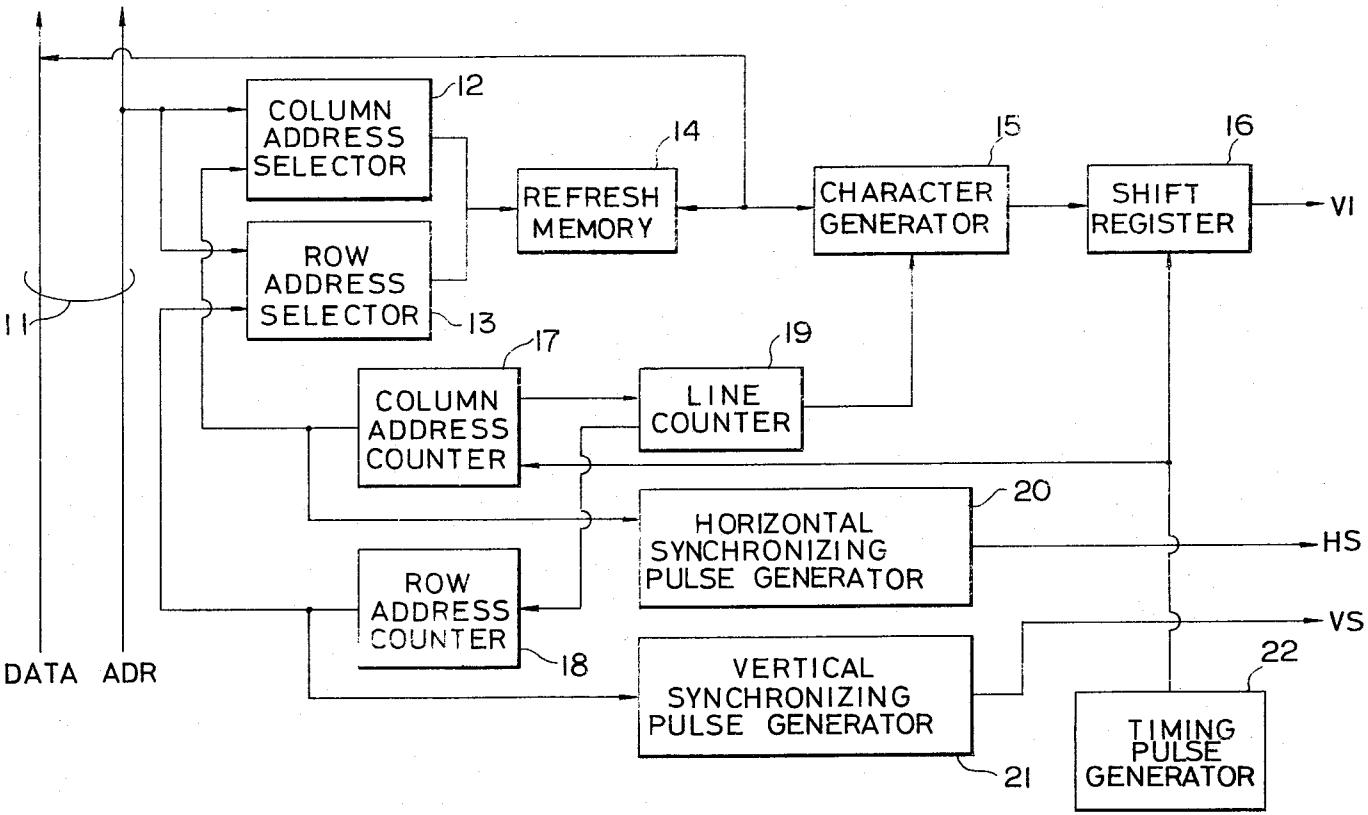
FIG. 4 PRIOR ART
FIG. 4 is a block diagram of the prior art control unit of a CRT display device.
Figure 5:
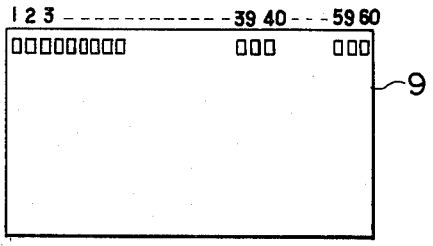
FIG. 5 is a schematic illustration of the print-out paper 9 on which some printed characters are shown to indicate that the paper 9 may contain 60 columns.
Figure 6:
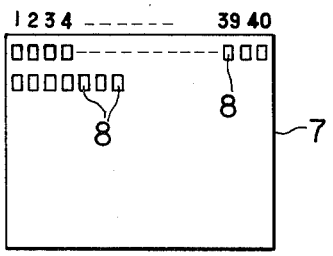
FIG. 6 PRIOR ART
FIG. 6 is a schematic illustration of the display area 7 in which the excessive characters are displayed in the next following row in accordance with the prior art.
Figure 7:
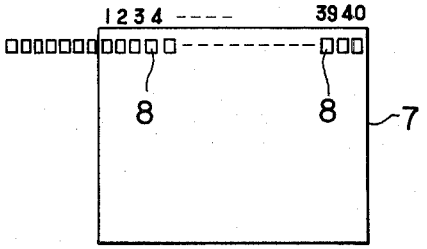
FIG. 7 PRIOR ART
FIG. 7 is a schematic illustration of the display area 7 in which the characters 8 are displayed in accordance with the prior art scroll method.

The programmable clock counter 39 is controlled by the signal CPR which is supplied from the counter controller 42 and the counter 39 has a choice of acting as a one-to-one counter, binary counter or tertiary counter in response to the signal CPR supplied thereto. For example, when acting as a binary counter, it counts the number of pulses of the fundamental pulse signal OC supplied from the fundamental oscillator 30 and supplies one clock pulse CLK as an output every two pulses of the signal OC. As mentioned previously, the character pattern generator 35 receives the address signal ADR for addressing a desired location therein. For the character pattern generator 35, use may be made of any general purpose type character pattern generators which are commercially available and store various character pattern information. If the letter "A", which has a character pattern as shown in FIG. 3, is addressed by the signal ADR, all of the information $D_1$ through $D_7$ of the top row $L_1$ are supplied to the shift register 36 at the same time as 7 parallel bits. Then, when the clock pulse signal CLK is supplied, the shift register 36 sends out the information $D_1$ through $D_7$ serially in time in the form of the video signal VI.

Now, even if the mode selection signal MS supplies a signal indicating the display mode 3 of FIG. 26, unless one of the counted numbers of the character count signals CC for all of the rows or raster sectors of the display area 7 exceeds the predetermined number "80", the counter program signal CPR maintains the counter 39 to be a binary counter and all of the characters are displayed in the standard format. However, if the counted number of the character count signal CC for at least one of the rows becomes "81", then the first overflow signal OF-1 is supplied from the column counter 41 to the counter controller 42.

Figure 22:
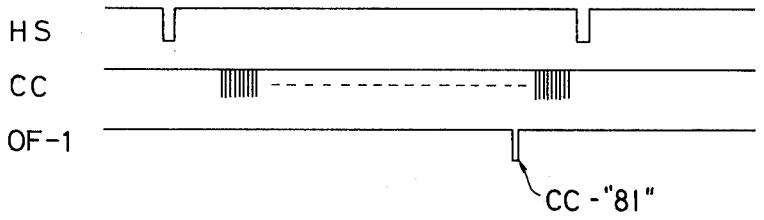
FIGS. 22 and 23 are timing diagrams which are particularly useful in understanding the operation of the block diagram of FIG. 21.

FIG. 22 is a time chart which is useful in understanding the operation of the present system when the first overflow signal OF-1 is supplied from the column counter 41. As shown, the first overflow signal OF-1 is produced at the time when the accumulated number of the character count pulses CC has reached "81", the location of which is indicated by CC-"81". After the production of this first overflow signal OF-1, the characters of the 81st column or more cannot be displayed in the display area 7 because all of the 80 characters have already been displayed extending from side to side of the display area 7.

However, once the overflow signal OF-1 has been supplied, the counter controller 42 controls the operation of the programmable clock counter 39 as in the below-mentioned manner starting from the next following row unless the reset signal RS is applied. That is, from the time when reset by the horizontal synchronizing signal HS until the production of the second overflow signal OF-2, the counter 39 is forced to act as a binary counter by the signal CPR, and during the period from the time of production of the second overflow signal OF-2 to the time of production of the third overflow signal OF-3, the counter 39 is forced to act as a one-to-one counter by means of the signal CPR. Upon production of the third overflow signal OF-3, the signal CPR causes the counter 39 to act as a binary counter again.

In the present embodiment, since the second overflow signal OF-2 is produced at the 70th column and the third overflow signal at the 90th column, the counter 39 remains to be a binary counter up to the 70th column and it changes to a one-to-one counter between the 71st and 90th columns, retruning to a binary counter at the 91st column or more. Of course, those characters in the 91st column or more cannot be displayed in the display area 7.

Figure 23:
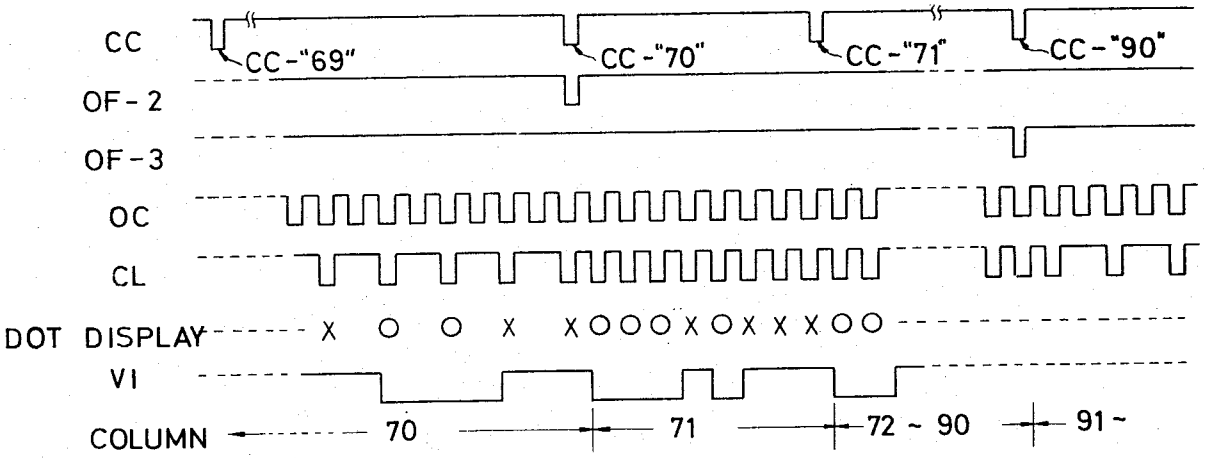

FIG. 23 is a time chart which is useful in understanding the operation of the block diagram shown in FIG. 21 when the second and third overflow signals are produced. At the time when the 70th character count signal CC is counted, the second overflow signal OF-2 is produced and then the counter 39 changes its state from a binary counter to a one-to-one counter. As a result, the clock signal CLK now has a pulse in correspondence with a pulse of the fundamental clock signal OC at the 71st column or more, though the clock signal CLK had a pulse per two pulses of the fundamental clock signal OC up to the 70th column. Therefore, the characters are displayed in the standard format up to the 70th column and the characters between the 71st and 90th columns are displayed as compressed with the size and pitch ½ of the standard format.

As described above, in this embodiment of the present invention, at the time of production of the first overflow signal OF-1, the display mode is switched from the standard mode to a compressed mode, or mode 3 in the above example. This switching of display modes is carried out momentarily somewhere during the raster scanning operation. Once switched, the selected display mode persists thereafter unless the reset signal RS is applied. That is, the selected display mode continues not only for the remaining portion of the current row but also for the subsequent rows.

If it is desired to select the other mode 2 or 4, it is only necessary to change the timing of producing the second and third overflow signals. Thus, use should be made of a programmable counter for the counters which produce the second and third overflow signals, respectively, so that the timing of procuding the signals OF-2 and OF-3 may be appropriately adjusted in association with the conditions of the mode selection signal MS. For example, for display modes 2 to 4 as shown in FIGS. 25 to 27, respectively, the timing of producing the overflow signals OF-1 through OF-3 should be preprogrammed as shown in the table below.

TABLE

| | OF-1 | OF-2 | OF-3 |
|---|---|---|---|
| Mode 2 | 81st col. | 70th col. | 90th col. |
| Mode 3 | 81st col. | 0 col. | 20th col. |
| Mode 4 | 81st col. | 0 cols. & 80th | 20th cols. & 100th |

When the standard mode, display mode 1, has been selected by the mode selection signal MS, the counter controller 42 forces the counter 39 to act as a binary counter through the signal CPR irrespective of the timing of producing the overflow signals OF-1 through OF-3. It should also be noted that the reduction ratio is not limited to ½ and any appropriate value such as ⅓ may be appropriately chosen. Moreover, the mode selection signal MS may be supplied by the operator or by the central processing unit.

Referring now to FIGS. 24 through 27, there are shown four different modes of displaying characters 8 in the display area 7 of the CRT screen. In this embodiment of the present invention, a cursor or indicator 50 is provided and the display mode is determined in accordance with the location of the cursor 50 as will be described below. The relationship between the location of the cursor 50 and the display mode may be summarized as in the following manner with the X denoting the column position.

| | |
|---|---|
| $1 \leqq X \leqq 25$ | Display Mode 2 |
| $26 \leqq X \leqq 75$ | Display Mode 4 |
| $76 \leqq X \leqq 90$ | Display Mode 3 |

Once a particular display mode has been selected, it remains unchanged even if the cursor 50 is moved. If it is desired to change the display mode, one of the partially compressed display modes must be freshly designated at an appropriate time. When designated, an appropriate display mode will be automatically selected in accordance with the current position of the cursor 50. However, it is to be noted that if the display mode is in mode 4 as shown in FIG. 27 and other compression modes are selected with the cursor 50 located at $X \geqq 91$, the mode 4 is again obtained. The reason why the display mode does not change in this instance resides in that the mode selection depends on the location of the cursor 50 only if the relationship $1 \leqq x \leqq 90$ is satisfied. If desired to return to the standard display mode of FIG. 24, it is only necessary to apply the reset signal irrespective of the location of the cursor 50 heretofore. The standard mode shown in FIG. 24 does not depend upon the location of the cursor 50.

Figure 28:
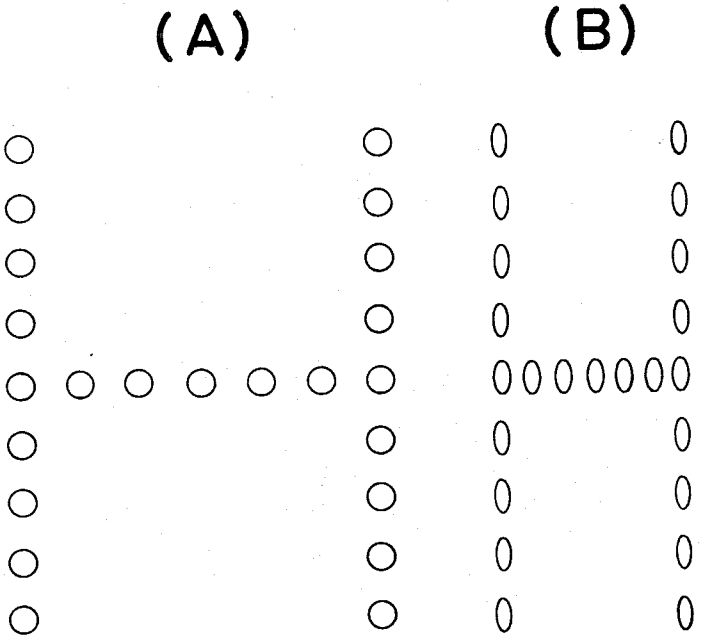
FIGS. 28 (A) and 28 (B) show two forms of the letter "H" which are displayed by the further embodiment of the present invention.

FIGS. 28(A) and (B) represent the letter "H" when displayed in accordance with the present embodiment. FIG. 28(A) is the case when the letter "H" is displayed in standard format; whereas, FIG. 28(B) is the case when displayed in compressed format. As shown clearly, the letter "H" shown in FIG. 28(B) has the width size and pitch which are ½ of those of the letter "H" shown in FIG. 28(B). However, the number of dots or the relative positional arrangement of the dots remain virtually unchanged between the two cases, and there is no need to provide a separate character pattern generator.

Figure 29:
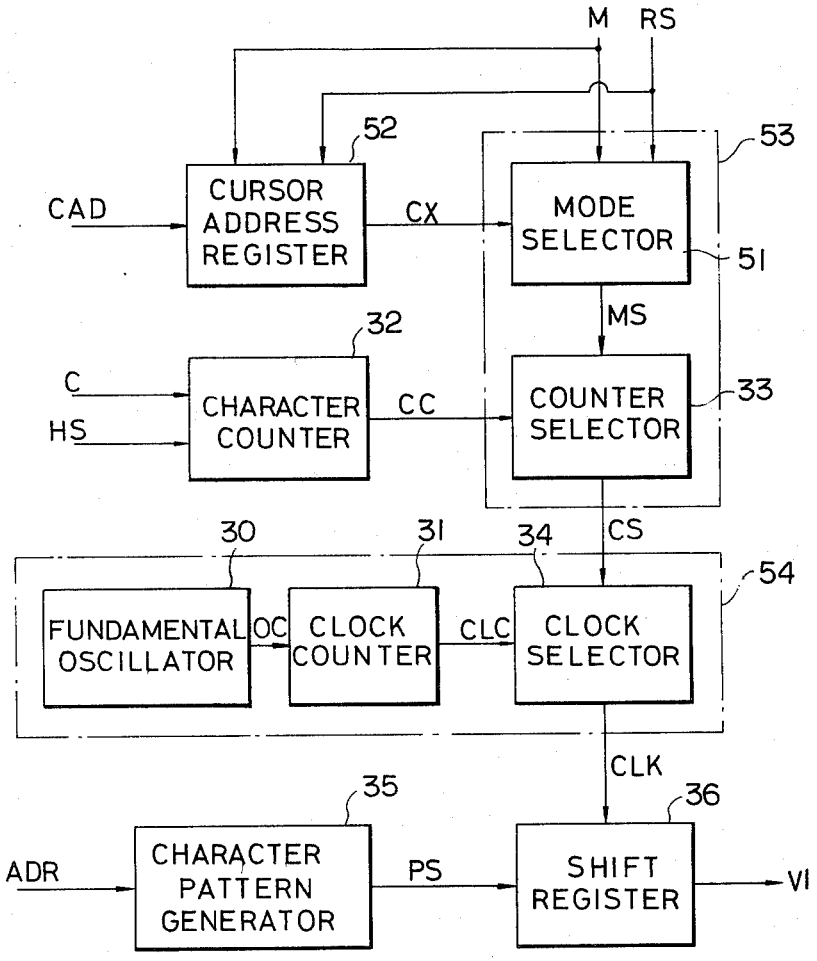
FIG. 29 is a block diagram showing a still further embodiment of the present invention.

FIG. 29 is a block diagram showing the structure of the further embodiment of the present invention which is characterized by the provision of a mode selector 51 and a cursor address register 52. The remaining components are all shown in FIG. 12. The mode selector 51 and the counter selector 33 are combined to form a region defining unit 53 which supplies an output signal CS as an input signal to the clock generator 54. When the compression display mode is designated, the compression mode designation signal M is supplied and then the cursor address register 52 receives a current cursor address signal CAD. Thus, the register 52 stores the information of the column address of the cursor 50 and at the same time supplies a cursor column address signal CX to the mode selector 51. Upon receiving the compression mode designation signal M and the cursor column address signal CX, the mode selector 51 selects one of the three display modes 2 to 4 and supplies the mode selection signal MS corresponding to the selected display mode to the counter selector 33. The rest of operation will manifest itself from the description with reference to FIG. 12.

In this embodiment of the present invention, since the information as to the location of the cursor 50 is always supplied in the selection of an appropriate display mode, it is insured that the region of interest is always displayed in standard format and therefore it is particularly advantageous for the operator.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A CRT display device for displaying characters in a standard display mode or at least one compressed display mode selectively by means of the raster type scanning along a predetermined number of character rows extending from one end to the other in the display area defined on the screen of a CRT, wherein the characters in said rows are displayed all in the same size when said standard display mode is selected, and wherein the characters in at least one of a plurality of columnar regions are displayed as compressed while displaying characters uncompressed in the other of said columnar regions, thereby maintaining legibility of characters in said other columnar regions while increasing the number of characters displayed in a character row when said compressed display mode is selected, comprising:

generating means for generating a dot pattern signal of a desired character to be displayed in the form of a dot matrix when an address signal is applied;

converting means for converting said dot pattern signal into a video signal to be applied to said CRT;

timing means for supplying a clock pulse signal including a pulse train to said converting means causing said converting means to supply said video signal in accordance with the frequency of said pulse train; and adjusting means for adjusting the frequency of said pulse train in response to a display mode selection signal applied thereto such that the frequency of said pulse train is maintained at a first predetermined frequency for all of said character rows when said display mode selection signal indicates said standard display mode, and the frequency of said pulse train is changed to a second predetermined frequency which is higher that said first predetermined frequency for characters in said at least one columnar region of a character row while maintaining said first predetermined frequency for characters in the other of said columnar regions therby maintaining legibility of characters in said other regions while increasing the number of characters displayed in a character row, whereby the characters in said at least one columnar region are displayed as compressed while other characters in said row are displayed as uncompressed in the other of said regions when said display mode selection signal indicates said at least one compressed display mode.

2. The CRT display device of claim 1 wherein said generating means comprises a general purpose character pattern generator which stores a plurality of characters in the form of the dot matrix.

3. The CRT display device of claim 1 wherein said converting means comprises a shift register which receives a dot pattern signal from said generating means in the form of a parallel input and supplies a continuous video signal as a serial output.

4. The CRT display device of claim 1 wherein said timing means comprises a fundamental oscillator for supplying a first pulse signal having a constant frequency; a clock counter which receives said first pulse signal and supplies a plurality of second pulse signals having different frequencies from each other; and a clock selector which selectively passes one of said second pulse signals to said converting means in accordance with said display mode selection signal fed from said adjusting means.

5. The CRT display device of claim 1 wherein said adjusting means comprises a character counter which receives a character signal and a horizontal synchronizing signal; and a counter selector which receives a signal from said character counter and (a) said display mode selection signal and supplies an output signal to said adjusting means.

6. The CRT display device of claim 1 wherein said timing means comprises a fundamental oscillator for supplying a first pulse signal having a constant frequency and a programmable clock counter directly connected to said fundamental oscillator for supplying said clock pulse signal of a desired frequency to said converting means.

7. The CRT display device of claim 1 further comprising cursor address registering means for supplying information as to the location of a cursor in the display area to said adjusting means, whereby a display mode is selected in response to the location of the cursor in the display area.

8. A display control system for use in a raster scanning type CRT display device for displaying characters in a plurality of character rows in a standard display mode or in at least one compressed display mode selectively in a display area defined on the screen of CRT, said character rows being previously divided into a plurality of columnar regions wherein characters are displayed all in the same size when said standard display mode is selected, and wherein characters in at least one of said columnar regions are displayed as compressed while displaying characters as uncompressed in the other of said columnar regions, thereby maintaining legibility of characters in said other columnar regions while increasing the number of characters to be displayed in a character row when said compressed display mode is selected, comprising:

character pattern generator means for supplying a dot pattern signal of a desired character in response to an address signal supplied;

shift register means connected to receive said dot pattern signal for producing a continuous video signal which is to be applied to said CRT;

clock pulse generator means for generating a pulse train to be supplied to said shift register means causing said shift register means to produce said video signal in accordance with the frequency of said pulse train; and controlling means connected to receive a display mode selection signal for supplying a control signal to said clock pulse generator means thereby setting the frequency of said pulse train such that the frequency of said pulse train is maintained at a first predetermined frequency for all characters in a character row when said display mode selection signal indicates said standard display mode, and the frequency of said pulse train is changed to a second predetermined frequency which is higher than said first predetermined frequency in at least one of said plurality of columnar regions of a character row while maintaining said first predetermined frequency in the other of said columnar regions, thereby maintaining legibility of characters in said other columnar regions while increasing the number of characters displayed in a character row, whereby the characters in said at least one columnar region are displayed as compressed while other characters are displayed as uncompressed in the other columnar regions when said display mode selection signal indicates said at least one compressed display mode.

9. The system of claim 8 wherein said controlling means comprises a column counter and supplies said control signal when said column counter counts up to a predetermined number of columns.

* * * * *

UNITED STATES PATENT AND TRADEMARK OFFICE

CERTIFICATE OF CORRECTION

PATENT NO. : 4,479,119

DATED : October 23, 1984

INVENTOR(S) : Yukio Sakamo

It is certified that error appears in the above-identified patent and that said Letters Patent is hereby corrected as shown below:

Title page:

The Foreign Application Priority Data is amended to change 55-100043 to 55-97114.

Signed and Sealed this

Twelfth Day of July, 1988

*Attest:*

*Attesting Officer*

DONALD J. QUIGG

*Commissioner of Patents and Trademarks*